US005239776A

United States Patent [19]

Lhotak

[11] Patent Number: 5,239,776

[45] Date of Patent: Aug. 31, 1993

[54] GARAGE DOOR OPENER

[75] Inventor: Roger W. Lhotak, Elburn, Ill.

[73] Assignee: The Chamberlain Group, Inc., Elmhurst, Ill.

[21] Appl. No.: 840,015

[22] Filed: Feb. 24, 1992

[51] Int. Cl.[5] ..... E05F 15/00; E05D 15/40

[52] U.S. Cl. ..... 49/199; 49/205

[58] Field of Search ..... 49/199, 200, 203, 205

[56] References Cited

U.S. PATENT DOCUMENTS

| | | | |
|---|---|---|---|
| 2,076,878 | 4/1937 | Brunst | 49/205 |
| 2,557,833 | 6/1951 | McFarlane | 49/205 |
| 2,753,179 | 7/1956 | Hahn | 268/74 |
| 2,912,237 | 11/1959 | Snyder | 268/74 |
| 2,985,446 | 5/1961 | Marmont et al. | 268/74 |
| 4,794,731 | 1/1989 | Willmott et al. | 49/199 |

FOREIGN PATENT DOCUMENTS

| | | | |
|---|---|---|---|
| 029423A1 | 11/1980 | European Pat. Off. . | |
| 029423B1 | 4/1984 | European Pat. Off. . | |
| 359873 | 3/1962 | Switzerland | 49/205 |

*Primary Examiner*—Philip C. Kannan

*Attorney, Agent, or Firm*—Fitch, Even, Tabin & Tabin

[57] ABSTRACT

A canopy garage door opener including a mechanism for interconnecting a horizontal, rectilinear reciprocating carriage drive means to a canopy door having a first axis fixed to the door and movable vertically in a guide means and a pair of crank arms pivoted at the top of a door opening and to a horizontal axis fixed with respect to the door. The mechanism includes a lever pivoted to the carriage forming part of a quadrangular link assembly pivoted to the door at one apex and connected by another link to the door from an adjacent apex. Guard means including fixed and movable plates are disposed on both sides of the mechanism to shield it, the movable plates being pivotally connected to the mechanism and being rotated by a cam and follower connection to the fixed plates.

17 Claims, 4 Drawing Sheets

FIG. 1
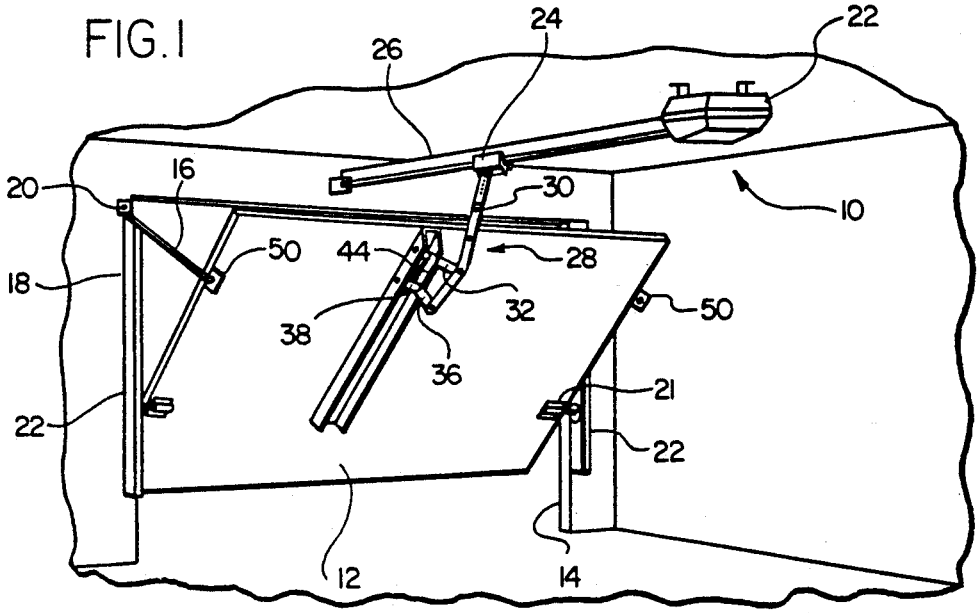
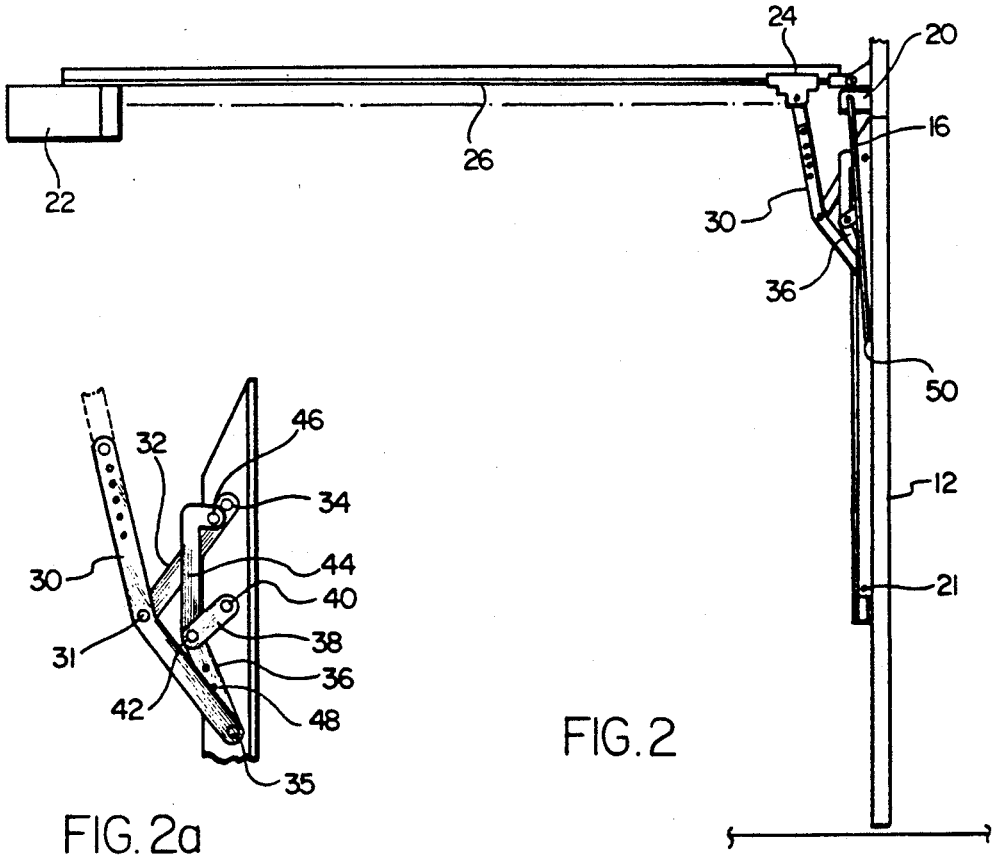
FIG. 2
FIG. 2a

FIG.3
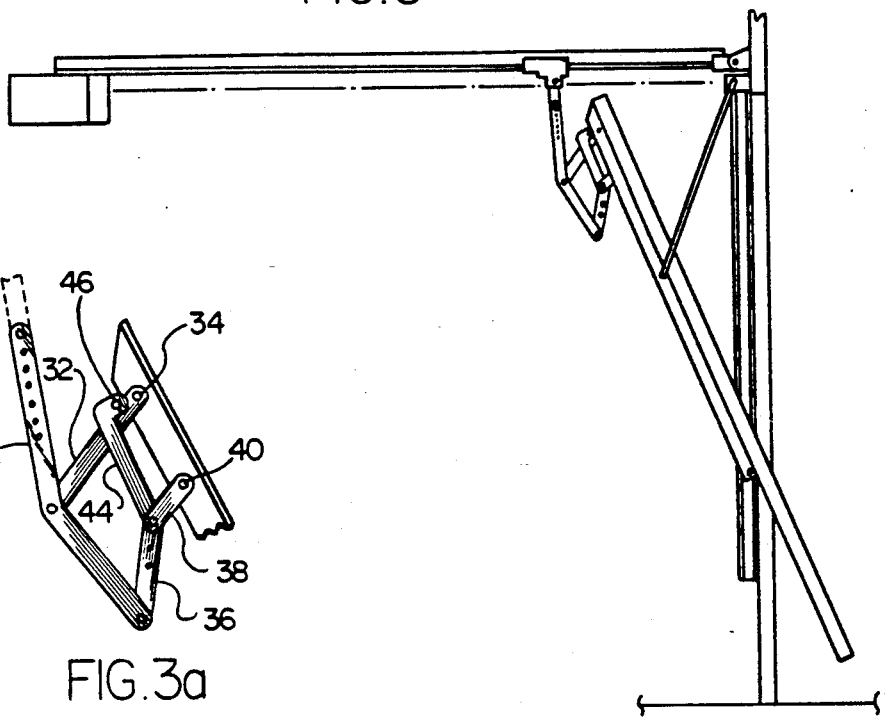
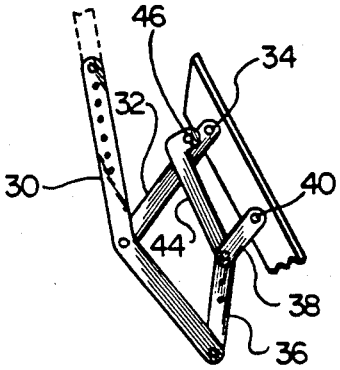
FIG.3a
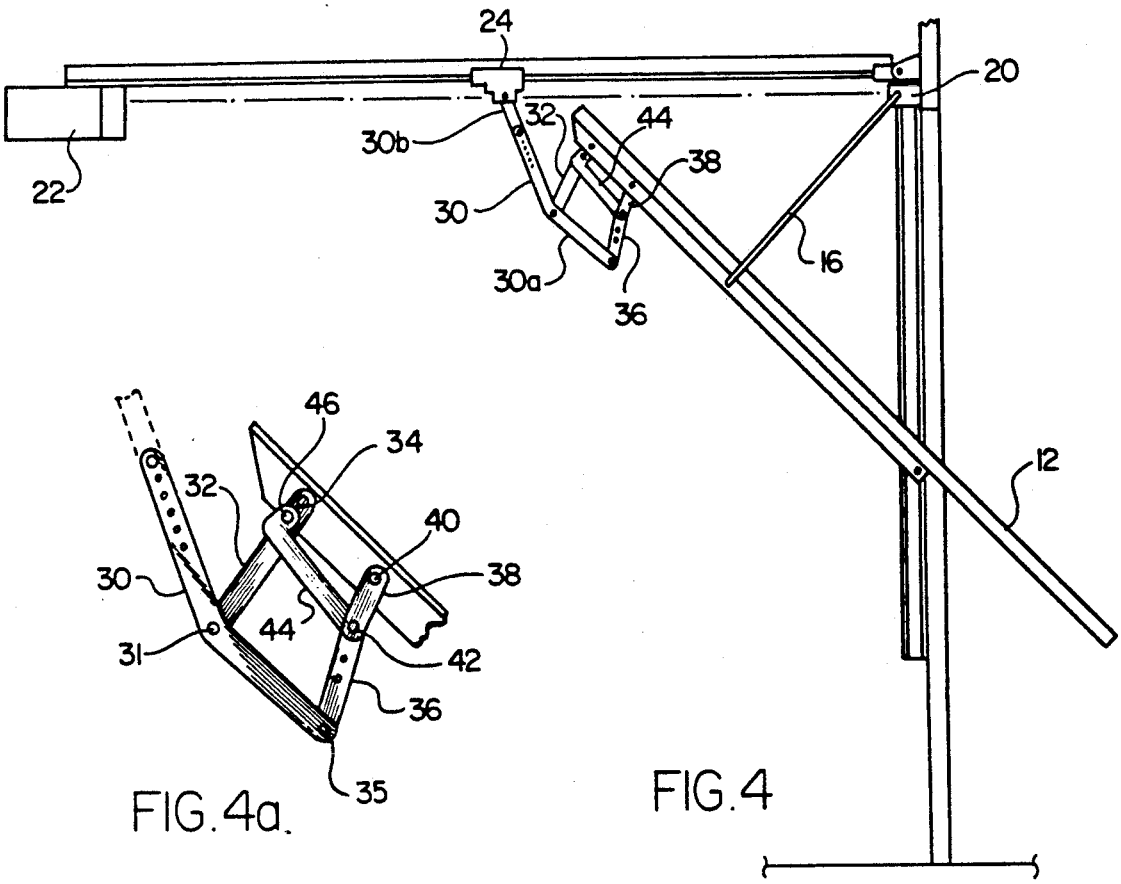
FIG.4a.
FIG.4

FIG. 5
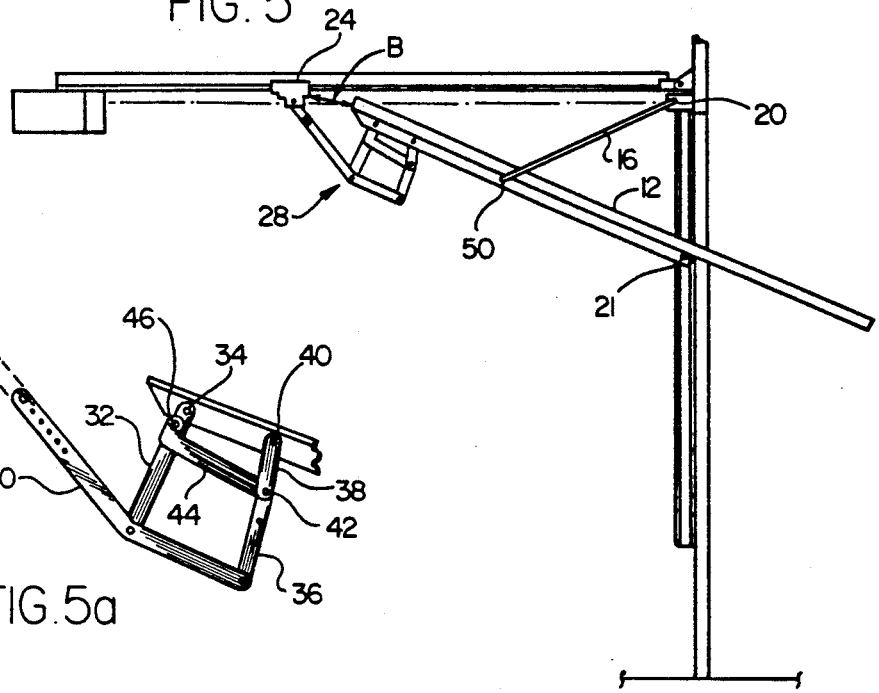
FIG. 5a
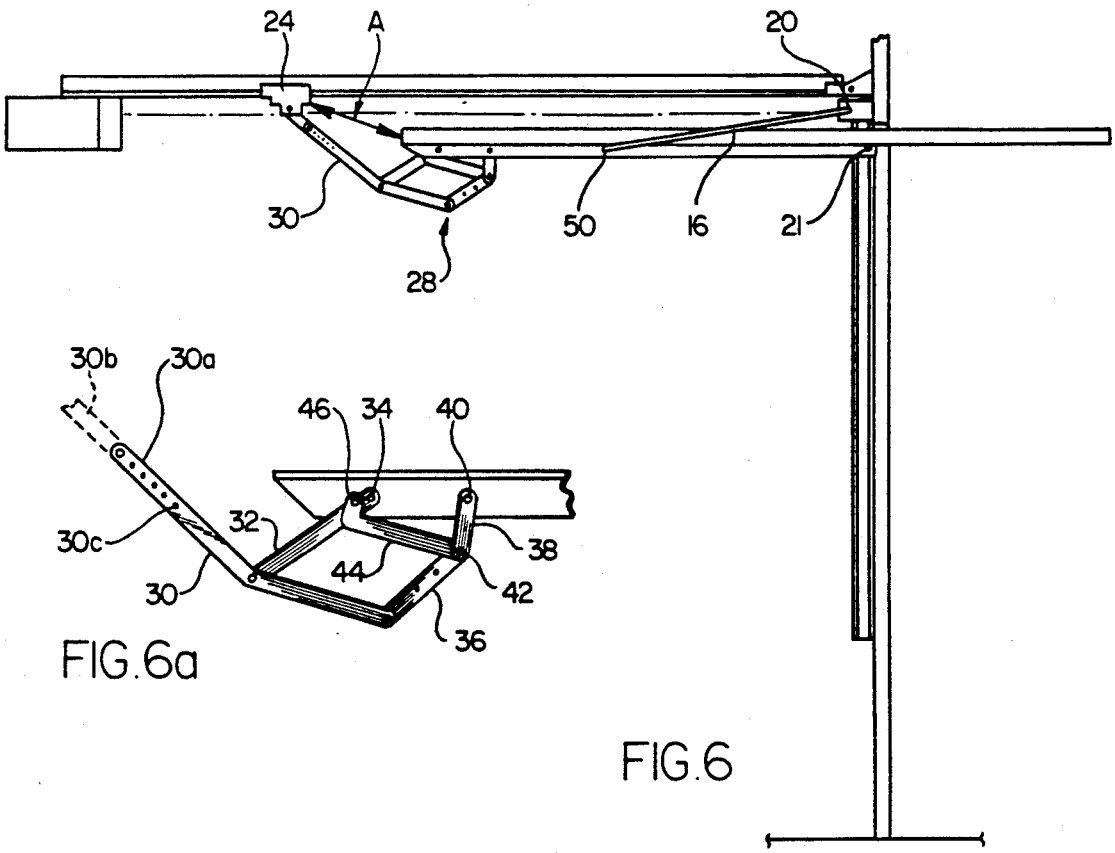
FIG. 6a
FIG. 6

GARAGE DOOR OPENER

FIELD OF THE INVENTION

The present invention relates generally to apparatus for opening doors and, more specifically, to a mechanism for opening canopy doors or doors requiring similar types of lifting and rotational forces. As used herein, canopy door describes a one-piece door as used for automobile garage access openings, which door is supported for pivotal and translational movement between a vertical, closed position and a horizontal open position in which it is located in spaced parallel relation to the ceiling of the interior of the garage.

BACKGROUND OF THE INVENTION

There are two broad categories of garage doors in common use which include one-piece canopy doors and track guided multisectioned doors. The latter category of doors has interconnected sections which are supported at both ends in tracks which extend along the sides of the door opening and continue along the ceiling of the garage so that the connected sections may be slid upwardly and inwardly from a closed to an open position. The one-piece canopy door is typically used for smaller garage openings and is less costly than the many hinged sections used in the multisection doors. In addition, the rollers and tracks used in multisection doors add installation costs and complications not associated with the canopy doors.

There are a number of different types of mechanisms used to support and move the canopy type door between its open and closed positions. The mechanism supports the door for pivotal movement between a vertical and horizontal position and at the same time raises it to the level of the top of the door opening as it moves to the horizontal position. Because of the space limitations arising from the garage ceiling being only slightly higher than the top of the door opening, the door opening mechanism must occupy a very limited vertically extending space above the door opening. As a consequence, the mechanism cannot project any appreciable distance above the door in its open, horizontal position. It is also important that the mechanism not swing the door horizontally inwardly any appreciable amount since such movement would subtract from the usable space within the garage.

One of the more commonly used mechanisms for supporting a canopy garage door is a type of slide crank mechanism wherein the door constitutes a connecting rod extending between the free end of a crank arm pivoted at the top of the door opening and a sliding bearing received in a vertical track along the edge of the door opening. Thus, there are two crank arms which pivot at the opposite edges of the door so that the crank arms move through an angle of approximately 90° as the door moves from the vertical to the horizontal open position with the crank arms essentially in line with the door in either the open or the closed door position. The above described door opening mechanism is shown in the European Patent No. EP 0029423, which issued Apr. 18, 1984. Examples of other types of mechanisms for supporting canopy type garage doors are shown in Snyder U.S. Pat. No. 2,912,237, Marmont et al. U.S. Pat. No. 2,985,446 and Hahn U.S. Pat. No. 2,753,179.

Many of the currently used mechanisms for supporting canopy type garage doors are relatively simple to operate manually. The doors are normally provided with springs to counterbalance the weight of the door. As a result, it is relatively easy for a person to open or close these doors by applying a lateral force and a vertical force in the form of a lifting force or a pull downwardly to overcome the inertia of the door and move it from one position to the other. However, it is often desired to equip such canopy doors with an automatic opening mechanism. In an automatic opening mechanism for a sectional door, it is relatively simple to secure the mechanism to the top of the door and draw the top edge of the door in almost a straight line along the horizontal portion of the door guiding track. The problem of equipping a canopy door with an automatic opener is much more complicated as a consequence of the combined rotational and translational movement of the canopy door in moving between the opened and closed positions.

The typical automatic garage door opening mechanism includes a carriage which is motor driven along a track or T-bar by means of a screw or a roller chain with the carriage moving back and forth along a rectilinear path. A coupling means is provided to interconnect the carriage to the door, with there normally being a disconnect means to decouple the carriage from the drive to permit manual operation of the door in the event of a malfunction or a power failure. While it is possible to design an automatic door opening mechanism specifically for the particular motion associated with a canopy door, it is preferable from a manufacturing cost standpoint and an inventory cost standpoint to use the same door opening mechanism for as many different types of doors as possible. It is also noted that most of the automatic garage door openers sold are for the multisectioned doors rather than the canopy doors. Accordingly, it would be desirable to adapt to use on the canopy door the typical automatic opening mechanism having a carriage which moves on a rectilinear path along a track. The Snyder and Marmont et al. patents cited above are examples of powered door opening mechanisms which are designed specifically for canopy door applications.

In order to understand the difficulty in driving a canopy door using the slider crank mechanism shown in the above cited European Patent with a rectilinear carriage movement, it is helpful to consider the forces necessary to initiate movement of the door from either the open or closed position. On the movement from the closed position, the door, the crank arms and the door bearings are all in line on a vertical line. If the carriage moves horizontally from a position above the door, it must pivot and lift the door at the same time and this action must be initiated from a position in which it applies enough forward pressure to hold the door closed. The three lever mechanism of the European patent cited above purports to perform this function of initiating movement from the closed position.

As the door moves toward the horizontal, open position, the door opening mechanism must provide sufficient rotating force on the door to lift the bottom edge of the door against the force of gravity toward the top of the door opening. In this position the door is substantially parallel to the path of movement of the carriage of the opening mechanism, making it difficult for the carriage movement to bring the door to the full open position. As soon as the process is reversed, the carriage moves in the door closing direction when it must provide a turning moment in the reverse direction to move the bottom of the door downwardly. The closing movement of the carriage tends to be along the line of the crank arms, which would restrain movement of the carriage until the door begins to rotate.

There are essentially two problems involved in the initial movement of the door from its open position toward the closed position. One relates to the in-line position of the bearings and need for a turning moment to start the door moving. The second problem relates to the slow movement of the top edge of the door in the horizontal direction as it begins its turning movement. More accurately, it should be described as the small amount of horizontal movement of the door for a certain amount of rotary movement. As the closing proceeds, much more horizontal movement is required to produce the same amount of rotary movement. Since the driving carriage of the door closer moves horizontally at a constant velocity, the carriage must move the door through a greater rotary movement initially than later in the closing cycle. As a consequence, the load on the motor tends to be very high in the initial portion of the closing cycle.

Further, as the canopy door moves into the closed position, the carriage must apply sufficient lateral force against the door to prevent it from being blown open or forced open. This force direction is difficult to achieve with the carriage position being above and adjacent to the door.

Another serious consideration in the design of a canopy automatic door opening mechanism relates to the necessary overload reverse switches. It is conventional to provide automatic garage door opening mechanisms with reversing means in the motor circuit so that if the door, on moving in the closing direction, encounters an obstruction, the door opening mechanism will reverse and open the door. This response is typically tied to an adjustable level of overload motor current or to a decrease in the rotating speed of the motor. Thus, as the motor draws more current or slows in speed upon encountering an obstruction, the circuit automatically reverses the direction of motor rotation to raise the door. The related problem involved with canopy doors is that fact that load on the motor is extremely variable in the automatic opening mechanism for a canopy door. As discussed above, at the initial stage of closing the door, the force required to be exerted by the carriage increases substantially. If the automatic opening mechanism is designed to perform continuously under the load conditions encountered near the open and closed positions, the overload reversal switching will, of necessity, occur at a high level of motor current or at a slow speed. Under such circumstances, there is risk of property damage, or damage to the door itself before the motor reversal would take place. Accordingly, it is desirable to reduce the peak power requirements during the opening and closing cycles to allow the reverse to be set at as low a current level or high a speed level as possible. Thus, it would be preferable to even out the load demand on the motor so that the reversal could be caused with only a small increase in motor current or a small decrease in motor speed.

Another problem associated with the canopy door is related to the nature of the door movement at closing as well as the manner in which it is driven. Only about one-third of the length of the door extends below the sliding bearing that engages the vertical track. As the door moves to its closed position, the top of the door is driven a greater distance than the bottom of the door which moves a relatively short distance. This provides a mechanical advantage by which a relatively small force at the carriage produces a large force at the bottom of the door. Again, if the overload reversal cannot be set at a relatively low value, the bottom of the door can apply a large force before reversal occurs. Accordingly, it is important to maintain the overload reversal level as low as possible by providing a drive mechanism which reduces the power peaks and evens out the load on the motor throughout the opening and closing cycles.

In addition to the one-piece canopy doors discussed above, there are other types of garage doors which present similar problems to those discussed above in connection with the canopy doors in adapting them to use with door openers having the rectilinear motion drive means. These other types include dual track, one-piece doors and bifold doors. The dual track doors have vertical and horizontal tracks extending up the sides of the door opening and inwardly from the top of the door opening to slidably support bearings on the sides of the door. Both of these types of doors require rotational and translational forces for opening and closing. Accordingly, the use of automatic door openers having reciprocating drive means that move horizontally on a rectilinear path with the dual track and bifold doors have presented the same types of problems as were discussed above in connection with the canopy door.

SUMMARY OF THE INVENTION

The present invention relates to a mechanism for interconnecting the carriage of an automatic door opening mechanism to a canopy type door or similar types of doors. The door opening mechanism includes a carriage which is power driven on a track following a generally horizontal, rectilinear path above the level of the door being opened and closed. In a canopy door, the door is positioned vertically in an opening, with the door being pivoted to the edges of the door opening in a track that permits the pivots to slide to the top of the opening as the door is opened. The pivotal connection between the door and the track is below the middle of the door and sometimes toward the lower edge of the door. A pair of crank arms are pivoted about fixed pivots at the top of the door opening with the other ends of the crank arms pivoted in the upper half of the door at the opposite edges. Thus, the door rotates between a vertical door closed position and a horizontal door open position, while at the same time traversing inwardly and upwardly to end up adjacent the ceiling of the garage.

The linkage interconnecting the carriage to the door includes a lever pivotally connected to the carriage at one end and extending generally parallel with the upper inside surface of the door and a series of links which connect the lever to two spaced pivot points on the door to apply translational and rotational motion to the door. Two of the links are connected to the lever at spaced points on the lever with one of the links connecting directly to the door. The second of these two links is connected to the door through a pivot, the position of which varies with the rotational position of the door. The varying position pivot to which the second link is connected provides a means for moving the rotational forces delivered by the carriage through the lever, depending on the varying center of rotation of the door itself.

This varying or shifting pivot to which the second link is connected is provided by a short link having one end connected to the door at a pivot spaced downwardly from the pivotal connection of the first link to the door. The other end of the short link is connected to the shifting pivot where it is pivotally connected to the second link and to one end of a floating link, the floating link having its other end connected to a pivot connection with the first link at a location eccentric with respect to the pivotal connection between the first link and the door. The floating link causes the short link to pivot through an angle of about 30° as the door moves from its open to its closed position. The linkage is configured to provide more uniform angular movement of the door as the carriage progresses in its rectilinear movement along its track. It has been found that prior art linkages, including linkages constructed in accordance with the teachings of the European patent cited above, tend to overload the drive motor by having linkages which in some stages of the cycle require substantially greater door rotation for a given amount of carriage movement. During these periods in which the door must rotate more rapidly to accommodate uniform rate of carriage movement substantially increased loads are placed on the motor, causing problems with the overload switching circuits which typically are used with automatic garage door opening mechanisms.

As the door is driven in its rotary and translational movement, the center of rotation varies from the lower door slide pivot at initial opening to the door-crank arm pivot at the full open position. In order to pivot the door at these end-most positions, the force directed through the carriage to the drive lever pivot must produce a turning moment on the door. Since in the case of closing the door, the carriage movement is parallel to the door and close to the center of rotation (the crank arm connection to the door) it is difficult to develop a turning moment without placing an overload on the motor. The shifting pivot redirects the turning moments produced by the lever on the door at opening and at closing so a more positive closing action is obtained and a more complete opening is achieved. In addition, in the initial movement stages either from the closed or open positions, the load on the motor is reduced by obtaining a more uniform rate of door travel throughout the opening and closing cycles and by providing increased turning moments on the door during these initial stages.

The linkage mechanism interconnecting the carriage to the door described above includes a lever and three links forming a quadrangle which assumes different shapes as the door moves to various positions with respect to the door opening. In the open position of the door, the quadrangle is folded or flattened so as to space the carriage at its maximum horizontal spacing or distance from the top edge of the door. During the initial portion of the closing cycle the quadrangle expands, reducing the horizontal distance between the carriage and the top edge of the door, which action reduces the load on the motor. At the closed position of the door, the quadrangle collapses or folds in a reverse direction to position the lever from the carriage at a favorable angle and engaged with the door to provide a more positive closing force on the door. Thus the linkage mechanism connecting the carriage to the door overcomes many of the objections to the use of the rectilinear movement drive in connection with a canopy type garage door. Although the invention is specifically disclosed as applied to a canopy door, it should be understood that it is equally applicable to other types of door which require combined rotational and translation forces to open or close them and are intended to be operated automatically by openers having drive means which move generally horizontally along a rectilinear path.

As an additional aspect of the invention, there is provided a simplified guard which eliminates any possibility of engagement with the linkage mechanism which interconnects the carriage of the drive means to the door. The guard includes fixed and movable guard plates which advantageously limit the extent to which the guard projects inwardly from the surface of the door. It would be impractical to completely enclose the linkage mechanism with a fixed guard, since such a guard would be required to extend outwardly a substantial distance from the inside surface of the door, thereby encroaching on the headroom available beneath the door when in the open position.

The guard of the present invention occupies no greater space inwardly from the inside surface of the door in the open or closed position of the door than does the linkage mechanism itself. However, in the intermediate positions of the door in which the linkage mechanism extends a greater distance from the inside surface of the door, the movable guard plates swing outwardly with the mechanism to continue shielding the linkage mechanism throughout the opening and closing cycles of the door.

Accordingly, it is an object of the present invention to provide an improved garage door opener for use on canopy type doors or the like.

It is another object of the present invention to provide an improved garage door opener utilizing a reciprocating drive which moves on a rectilinear path to drive a canopy type door or the like.

It is a further object of the present invention to provide an improved linkage mechanism to connect a rectilinear drive to a one-piece type of door to reduce peak loads on the drive motor and provide a more positive closing force.

These and other objects of the invention should be apparent from the following detailed description for carrying out the invention when read in conjunction with the accompanying drawings.

BRIEF DESCRIPTION OF THE DRAWINGS

FIG. 1 is a perspective view of a canopy garage door with a garage door opener embodying the present invention;

FIGS. 2–6 are elevational views of the canopy door and opener of FIG. 1 showing the door in various positions from fully open to closed, with FIGS. *2a–6a* being enlarged fragmentary elevational views of the drive linkage mechanisms shown respectively in FIGS. 2–6;

DETAILED DESCRIPTION OF PREFERRED EMBODIMENTS

Figure 7:
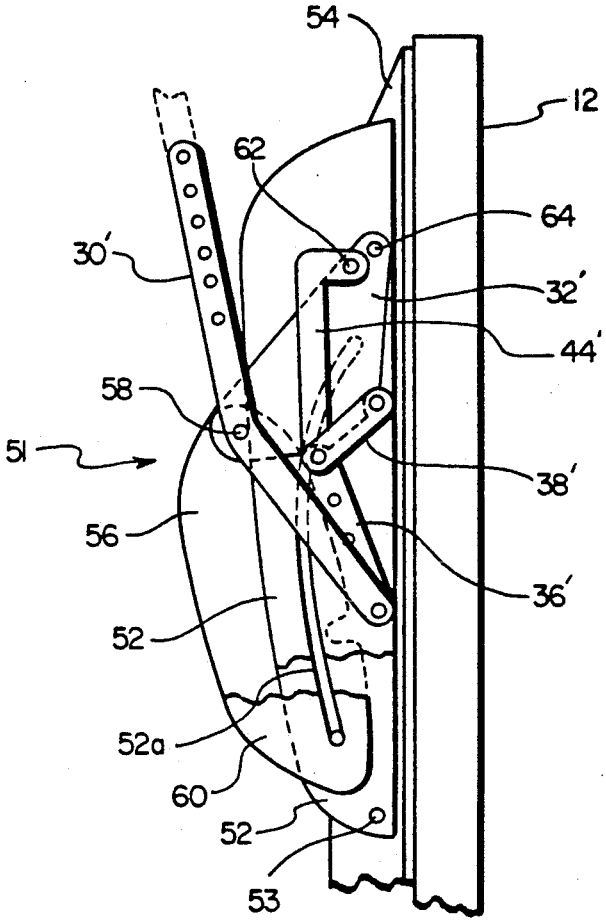
FIG. 7 is an elevational view of an alternative embodiment of a linkage mechanism having a guard embodying the present invention with the mechanism shown in the door closed position.

Referring to the drawings, there is shown an automatic garage door opener 10 embodying the present invention. The opener 10 is shown as applied to a canopy door 12 which is associated with a garage opening 14. As stated above, the present invention is applicable to other types of garage doors which require rotational and translational forces to open and close the doors similar to the forces required in operating a canopy type door. The canopy door 12 is a one-piece door supported for movement from a vertical position closing the opening 14 to a raised, horizontal position in which it is substantially level with the top of the opening 14.

The mechanism for supporting the door 12 for movement between these open and closed positions includes a pair of crank arms 16 pivotally connected to the upper part of a door frame 18 by brackets 20. The crank arms 16 are pivotally connected at the other ends to door 12 along the side edges of the door at a point down from the top a distance equal to about a third of the height of the door. A pivot connection or bearing 21 on each side edge of the door is received in a track 22 which extends to the top of the door frame 18. The axis of the pivots 21 is located in the bottom half of the door 12, often toward the bottom edge. Thus, as the door opens, the pivot 21 slides upwardly in the track 22, allowing the door 12 to pivot while, at the same time, it is guided by the crank arms 16. This mechanism is sometimes referred to as a sliding crank.

Connected to the door 12 is the automatic opener 10 which includes a motor operated power drive 22 which drives a screw or roller chain to drive a carriage 24 mounted for rectilinear movement along a generally horizontally disposed track 26. The door opener 10, including the power drive 22 and the track 26, are designed to be mounted adjacent the garage ceiling which is usually immediately above the door 12 in its raised position. For the purpose of interconnecting the carriage of the door opener 10 to the door 12, there is provided a linkage mechanism 28 which is pivotally connected to the door 12 and the carriage 24.

As a consequence of the limited space between the door and the ceiling, it has been difficult to design a satisfactory linkage mechanism to convert the rectilinear motion of the carriage to drive the door 12 in its rotational and translational movement. The problem is particularly significant at the limits of travel of the door, i.e., at the open and closed positions when the drive means including the carriage is almost in-line with the door which must be rotated into and out of those positions.

The mechanism 28 which interconnects the carriage 24 and the door 12 includes a lever 30 which is pivotally connected to the carriage at one end and to the door through a series of links at the other end. The lever 30 is adjustable in length, having a body portion **30*a* which is formed with a bend intermediate its ends and having an extension portion 30*b* which is coextensive and in abutting engagement with a portion of the body portion 30*a*. A plurality of openings 30*c* are provided to permit the extension portion 30*b* and the body portion 30*a* to be bolted together with a selected amount of overlap to accommodate variations in the positions of the carriage 24 and the door 12** on installation of the door opener.

In order to join the lever 30 to the door 12, there is provided a first link 32 pivotally connected at one end to the lever 30 at pivot 31 with the other end connected to the door at pivot 34. A second link 36 is pivotally connected at one end to the lower end of lever 30 at pivot 35 and is connected at the other end to a short link 38, which is pivotally connected at pivot 40 to the door 12. The purpose of the short link 38 is to provide a shifting point 42 at which the second link 36 pivots with respect to the door 12, depending on the angle of the door.

The shifting of the pivot 42 is accomplished by means of a floating link 44 that is pivoted at 42 on one end and at a pivot 46 at the other end. The floating link is pivotally connected to the first link 32 at pivot 46 which is spaced from the axis of pivot 34 where the first link connects to the door 12. Thus, when the first link 32 swings about the pivot 34, the floating link 44 shifts generally lengthwise, rotating the short link 38 and shifting the pivot 42. The floating link 44 has a somewhat L-shaped configuration so that the pivot 46 is offset with respect to the main body of the link 44. This configuration is necessary to avoid interference between the link 44 and the pivot 34 when the door is in the fully opened position.

The shifting pivot 42 provided by the short link 38 and the floating link 44 insures more positive driving forces at the open and closed positions of the door 12. As the door 12 moves to the full open position shown in FIG. 6, the crank arm 16 pivots at a point 50 with respect to the door 12 and the door pivots about the sliding pivot 21. As noted from FIG. 6, the pivots 50 and 21 are essentially on the same horizontal line. Thus, as the door 12 moves to its open position, the opener should desirably apply a counterclockwise turning moment to the door to achieve the fully open position. One of the main shortcomings of the prior art open mechanisms for canopy doors or the like is the inability to completely raise the door to the horizontal, full open position. When the door moves from the fully open position, a turning moment in the clockwise direction is required. A straight horizontal force tends to jam or lock the mechanism because of the alignment of the pivots 50 and 21. With the first and second links 32, 36 rotated to their limit in the clockwise direction, the connection between the carriage and lever 30 is offset sufficiently to apply a satisfactory turning moment on the door 12.

When the door 12 reaches the closed position as shown in FIG. 2, the floating pivot 42 allows the second link 36 to move through a substantial angle counterclockwise, so that the lever 30 angles outwardly with respect to the door, allowing it to exert a positive closing force. Because of the fact that the carriage is close to the plane of the door, it is often difficult to exert a large enough force to maintain the door closed. In the disclosed embodiment of the door opener of the present invention, the lever 30 moves through an angle of 54°, allowing the carriage to drive from a displaced position on one side of the door in the open position as shown in FIG. 6 and a similarly displaced position on the other side of the door in the closed position as shown in FIG. 2.

Many prior art parallelogram type linkages have a tendency to lock up at the limits of their travel, whereas the floating link 44 and shifting pivot 42 for the second link 36 in the present door opener mechanism completely eliminate any tendency to lock up.

Another difficulty with door opener mechanisms for canopy or similar type doors that is solved by the present invention is that of the varying load placed on the drive motor as the door is moved from the open to the closed position. The motor for the door opener is a constant speed motor that drives the carriage 24 at a uniform speed along the track 26. If one considers the horizontal movement of the top of the door 12 as compared to its angular movement, it will be noted that the initial rotary movement of the door moving from the open position produces relatively little horizontal movement. The significance of this fact is that the motor must rotate the door much faster initially than it does later in the cycle if the carriage is to move at a uniform rectilinear speed. Tests of prior art parallelogram-type linkages have shown that this added load on the motor in requiring it to initially move the door more rapidly during this initial period has caused peak currents substantially greater than the average current required by the motor for opening the door. Although forces tend to vary on the doors of different manufacturers, tests comparing the mechanism 28 of the present invention against the parallelogram-type linkage show a 35% reduction in the peak currents with the present invention.

In order to lessen this initial motor load as the door is driven from its open position, the mechanism 28 of the present invention provides a collapsing function whereby during the first 22½° of door movement the mechanism 28 causes the distance from the carriage to the door 12 to shorten by about 43%. The effect of this changing distance between the carriage and the door is to allow the carriage to travel a greater distance in moving the door a given distance than it would if it were directly coupled to the door. This, in turn, extends the time for the motor to accomplish this initial movement of the door and therefore lessens the peak motor load that would otherwise occur during this initial period.

The particular type of canopy door with which the present invention is concerned has many advantages flowing from the simple crank arm and sliding bearing support for the door. The structure of the door support mechanism is inexpensive to manufacture and easy to install. The somewhat unusual motion of the door as it slides and rotates is very easy to operate manually, but does not adapt well to automatic operation. The standard opener for sectional doors having a track-supported drive carriage mounted for rectilinear movement will not operate the canopy-type door or similar type doors if the drive carriage is directly connected to the door. A linkage mechanism must be utilized between the horizontally reciprocated carriage and the door to accommodate the rotational and translational movement. There have been various mechanisms including the parallelogram-type shown in the above cited European patent. With such mechanisms, there is produced a high motor load during initial closing movement which tends to interfere with the normal mechanisms used on garage door openers. The mechanisms have typically relied on motor overload currents or motor speed to indicate when the descending door has encountered an object. On the occurrence of such an overload, the motor circuit would automatically reverse the motor rotation by reversing the direction of current flow to the motor. With the high overload or peak currents resulting from driving the canopy door with the carriage moving rectilinearly, the circuit would be triggered as the door started down and reverse to the raised position even though there was no obstruction. If the overload current level necessary to trigger the reverse were set too high, the user runs the risk of having the reversal of the door delayed. The action of the mechanism 28 in distributing the initial load of moving the door in the closing direction by allowing the carriage 24 to move a greater distance while moving the door a lesser distance results in lower peak motor currents and more constant motor speed.

To illustrate this action, the distances A and B in FIGS. 5 and 6 between carriage 24 and door 12 may be compared. FIG. 6 illustrates the door 12 in the full open position and FIG. 5 illustrates the door having moved 22½° toward the closed position. This comparison illustrates that because of action of the mechanism 28 during this closing movement, the carriage has moved a much greater distance than if it were coupled by the lever 30 directly to the door. Thus, as the door 12 moves from the full open position of FIG. 6 to the position shown in FIG. 5 the distance between the carriage 34 and the door 12 is reduced by more than half, the ratio of A to B being about 2.1. This change is reflected in less door movement for a given distance of travel of the carriage, which in turn reduces the peak load during this portion of the closing cycle.

As shown in FIG. 6, the mechanism 28 folds to a position to provide the force retaining the door 12 in the closed position. The carriage 24 is well spaced from the plane of the door with the linkage folded toward the door so that the lever 30 may apply its force toward the door 12. A stop pin 48 is mounted on link 36 so as to project into the path of lever 30 to prevent the end of lever 30 from swinging into engagement with the door 12. The second link 36 rotates through a substantial angle of rotation in moving from its door open position shown in FIG. 6, to the door closed position shown in FIG. 2, where it is pivoted against the door at the connection between it and lever 30. Even though the mechanism 28 provides a positive closing force in the closed position, there is no tendency for the mechanism to lock up in that position when the carriage 24 moves in the opening direction.

In considering the manner in which the mechanism 28 functions, it should be noted that the lever 30 and the first link 32, the second link 36 and the third or floating link 44 form a quadrangle which assumes a collapsed or flattened shape at the limits of the door travel as shown in FIGS. 2 and 6. In intermediate door positions as shown in FIGS. 4 and 5, the quadrangle is expanded to its maximum height or, stated alternatively, extends the maximum distance inwardly from the inner surface of the door 12. The flattened positions of FIGS. 2 and 6 are reversed in that the acute angles are between links 36 and 44 in the open position and between links 32 and 44 in the closed position. This reversal permits the carriage to drive from displaced positions on the front side of the door in FIG. 6 and the rear side as shown in FIG. 2. As stated above, the angular disposition of the lever 30 with respect to door 12 improves the action of the carriage 24 in opening and closing the door 12. The addition of the shifting pivot 42 supported by the floating link 34 and the short link 38 provides a significant improvement as compared to the prior art simple parallelogram mechanism exemplified by the European patent cited above. The additional links cost very little and added significantly to the performance of the door opening mechanism, eliminating major objections to the use of the rectilinear type drive mechanism on the canopy door or doors requiring similar rotational and translational forces for opening and closing. The door drive mechanism of the present invention allows the door to open completely by a carriage operating on a track supported horizontally immediately above the door in its open position. The mechanism also allows the door to be held closed with a direct force against the door. Finally, by allowing the door to close more slowly during the initial closing movement, the peak motor currents are reduced sufficiently and the motor speed maintained sufficiently uniform to permit use of the standard overload type reversal circuits.

Figure 8:
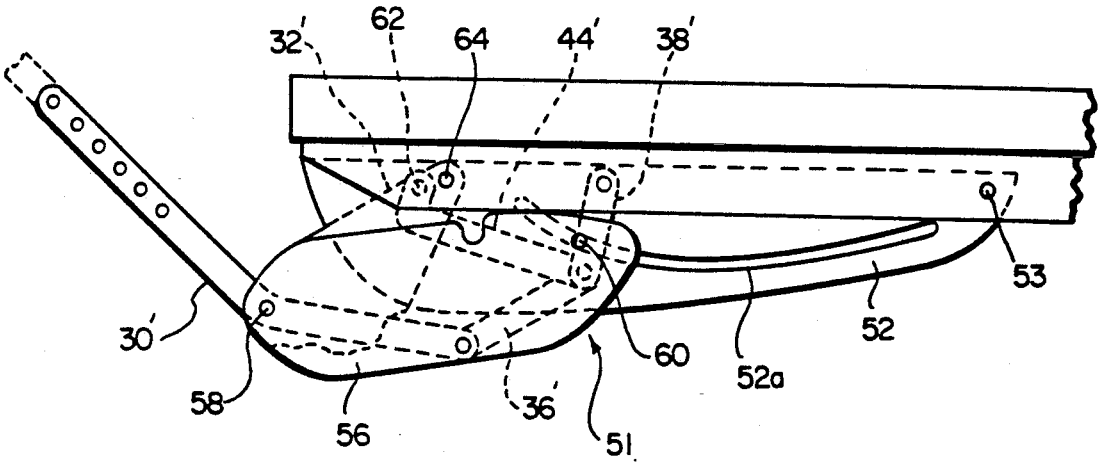
FIG. 8 is an elevational view similar to FIG. 7 but with the linkage mechanism and guard shown in the door open position.

In FIGS. 7 and 8 of the drawings there is shown an alternative embodiment of the invention which differs primarily from the embodiment of FIGS. 1 to 6 in providing a guard 51 for a linkage mechanism 28' which includes lever 30', a first link 32', a second link 36', a floating link 44' and a short link 38' pivotally connected to a door 12. The arrangement of the lever 30' and the connected links is identical to the embodiment of FIGS. 1–6, with the exception of the shape of the first link 32' which forms a part of the guard 51.

The guard 51 includes a pair of parallel spaced fixed guard plates 52 which are fixedly secured to door 12 by bolts 53 extending through openings in the angle brackets 54, to which the links 32' and 38' are pivotally connected. The angle brackets 54 are centrally affixed to the door 12 and extend downwardly from the top of the inside surface of the door 12. The fixed guards 52 straddle or enclose the lever and links and serve to shield portions of the mechanism as it moves during the opening and closing of the door. The fixed guards 52 are each formed with a curved lengthwise extending slot **52*a* which serves as a guide or cam for a pair of movable guards 56**.

The guards 56 are positioned in parallel spaced relation in sliding engagement with the fixed guards 52. A pivot member 58 pivotally connects lever 30', first link 32' and the movable guards 56. At the end of the guards 56 remote from the pivot member 58, the guards 56 are formed with a slider or cam follower 60 which slidably connects movable guard 56 to the fixed guard 52, the slider 60 being engaged with the slot **52*a***.

In the embodiment of FIGS. 7 and 8, the link 32' comprises two identically shaped generally triangular plates which straddle the lever 30' and the floating link 44', being pivotally connected at 58 to lever 30' and at a pivot 62 to the floating link 44'. The link 32' is pivotally connected at pivot 64 to angle bracket 54 which is fixed to door 12. It is noted that the link 32' extends laterally well beyond the line between the pivots 58 and 64. This lateral extension toward the links 36' and 38' is for the purpose of providing a guard for portions of the linkage mechanism in cooperation with the fixed guards 52 and the movable guards 56. The guards 52 and 56 along with the link 32' all move with respect to one another as the mechanism 28' expands and collapses as described above in driving the door 12 through its range of movement. This sliding and overlapping arrangement of the guards 52, 56 and the link 32' shields all of the interconnected links from being accidentally engaged.

As may be noted from FIGS. 7 and 8, the guard 51 lies fairly flat against the inside surface of the door 12, projecting only slightly farther inwardly than the mechanism 28' itself. At the same time, the guard 51 is adapted to expand as the quadrangle of the mechanism 28' expands to continue to shield the links of the mechanism 28'. Because of the limited space available in most garages using canopy doors, it is important that the guard 51 for the linkage mechanism 28' provide a minimum encroachment into the volume of space inside of or beneath the door 12. The guard of the present invention using the fixed and movable guards and the enlarged link 32' accomplishes this objective of minimizing the projection of the guard to that necessary to shield the linkage mechanism at its various positions in operating the door.

While the apparatus of the invention has been described in terms of a preferred embodiment, it is to be understood that various changes and modifications may be made within the purview of the appended claims without departing from the true scope of the invention in its broader aspects.

What is claimed is:

1. A garage door opener for opening a one-piece door which is mounted for rotational and translational movement from a vertical door closed position obstructing an opening to a horizontal door open position extending inwardly from the upper edge of said opening, the garage door opener comprising:

a carriage movable horizontally on a rectilinear path above said door in the open position;

linkage means for connecting said carriage to said door to drive said door between said open and closed position, said linkage means including:

an elongated lever pivotally connected at one end to said carriage and connectable to said door by a first link pivotally connectable to said door and to said lever at a point intermediate its ends, second and third links for connecting the other end of said lever to said door, said second link being pivotally connected to the other end of said lever, said third link being pivotally connectable to said door, and said second and third links being pivotally connected to one another and defining a floating pivot at the pivotal connection therebetween, said floating pivot being movable across the rear face of said door from an uppermost position when said door is in said open position to a lowermost position when said door is in said closed position, said one end of said lever being positionable by said first and second links at a location on one side of said door in the door open position and at the other side of said door in the door closed position.

2. A garage door opener in accordance with claim 1 wherein said linkage means lessens the spacing between said carriage and said door as said door moves from said open position toward said closed position to reduce the load on the motor during the initial movement of said door.

3. A garage door opener in accordance with claim 1 wherein said first and second links are connected by a fourth link having one end pivoted at said floating pivot and the other end pivoted to said first link at a location spaced from the pivotal connection between said first link and said door whereby said third link shifts lengthwise moving said floating pivot as said door moves between open and closed positions.

4. A garage door opener in accordance with claim 3 wherein said lever and said first, second and fourth links form a quadrangle which is collapsed when said door is in the open position and which expands as said door moves from said open position to shorten the distance between said carriage and said door to lessen the load on the motor during the initial movement of said door.

5. A garage door opener in accordance with claim 1 including guard means disposed on said door parallel to and coextensive with said linkage mechanism, said guard means including a pair of elongated fixed guards mounted on said door perpendicular thereto in parallel spaced relation enclosing said linkage mechanism in one position of said door, and a pair of movable guards mounted to slidably engage said fixed guards and being pivotally connected to said linkage to shield portions of said linkage mechanism which move from between said fixed guards during operation of said door.

6. A garage door opener in accordance with claim 5 wherein said fixed and movable guards include a cam and cam follower to rotate said movable guards during operation of said door.

7. Apparatus for opening and closing a door which is movable between a vertical closed position and an elevated horizontal open position with the door being pivotal about a first horizontal axis fixed with respect to the door and vertically displaceable in vertically extending guide means, and a pair of crank arms pivotally connected at one end at the top of said guide means and to the edges of said door at a second horizontal axis fixed with respect to the door and spaced upwardly from said first axis to guide the door in its movement between the open and closed positions comprising:

a carriage;

an elongated track for guiding said carriage for movement in a generally horizontal direction above the open position of said door;

reversible drive means connected to said carriage for reciprocating said carriage along said track;

linkage means for interconnecting said carriage and said door to impart translational and rotary movement to said door in moving between said open and closed positions, said linkage means including:

a lever pivotally connected to said carriage at one end and having a first link pivotally connected at one end to a middle portion of said lever, said first link being pivotally connectable to said door at the other end of said first link;

a second link pivotally connected at one end to the other end of said lever and connected to a third link at the other end of said second link at a point spaced toward said lower edge of said door from said pivotal connection of said first link to said door, the other end of said third link being pivotally connectable to the door, and a fourth link pivotally connected to an intermediate portion of said first link at one end thereof and to the pivotal connection of the second and third links at the other end thereof.

8. Apparatus for opening and closing a door as recited in claim 7 wherein said first link is disposable at a first acute angle with respect to the upper portion of said door in the open position and wherein said first link is disposable at said first acute angle with respect to the lower part of said door in the closed position of said door.

9. Apparatus for opening and closing a door as recited in claim 7 wherein said lever includes a first portion extending between said carriage and the pivotal connection with said first link and a second portion extending between said first portion and said other end, said first and second portions being at an obtuse angle to each other.

10. Apparatus for opening and closing a door as recited in claim 7 wherein said door has an outwardly facing front surface and an inwardly facing rear surface, said lever and said first, second and fourth links forming a quadrangle which is flattened in one direction to permit said carriage to drive from a displaced position in front of the front surface of the door and wherein said quadrangle is flattened in a reverse direction to permit said carriage to drive from a displaced position behind the rear surface of said door.

11. Apparatus for opening and closing a door which is movable between a vertical closed position and an elevated horizontal open position with the door being pivotal about a first horizontal axis fixed with respect to said door and displaceable in vertically extending guide means, and a pair of crank arms pivotally connected at one end at the top of said guide means and to the edges of said door at a second horizontal axis fixed with respect to said door and spaced upwardly from said first axis to guide the door in its movement between the open and closed positions comprising:

a carriage;

an elongated track for guiding said carriage for movement in a generally horizontal direction above the pen position of said door;

linkage means for interconnecting said carriage and said door to move said door between said open and closed positions;

said linkage means including a drive lever pivotally connected to said carriage at one end, first and second links pivotally connected to said lever at spaced locations at the other end of said lever, said first and second links being connected by a third link to form a quadrangle with said lever;

said lever and links forming said quadrangle being connectable to said door and said carriage so that said quadrangle is flattened in one direction with said door in the open position and flattened in a second direction when said door is in said closed position.

12. Apparatus in accordance with claim 11 wherein said quadrangle formed by said lever and said links is connectable to said door by a pivotal connection of said first link to said door and by a pivotal connection of a fourth link to said door and to the interconnection of said second and third of said links.

13. Apparatus in accordance with claim 12 wherein said lever in the closed position of said door angles away from said door with said other end of said lever abutting said door to apply a direct force closing said door.

14. Apparatus in accordance with claim 11 wherein said linkage means contracts the spacing between said carriage and said door as said door moves from said open position, causing said quadrangle to expand from its flattened position.

15. Apparatus in accordance with claim 14 including a motor driving said carriage along said track at a substantially constant speed, said contraction of said spacing between said carriage and said door reducing the load on said motor during the initial movement of said door from the open position.

16. A protective guard for use with a garage door opener of the type having a multilink mechanism interconnecting a garage door with a carriage drive mounted for horizontal rectilinear movement comprising:

a first pair of spaced parallel guard plates fixed to a garage door enclosing a portion of a multilink mechanism interconnecting a carriage drive with a garage door;

a second pair of spaced parallel guard plates pivotally connected to an element in said multilink mechanism which shifts outwardly from the said door as the door moves between an open and a closed position, said second pair of guard plates having a slidable connection with said first pair of guard plates whereby said second pair of guard plates rotate outwardly and traverse laterally with respect to said guard to constantly shield said multilink mechanism during movement of said door.

17. A protective guard for use with a garage door opener in accordance with claim 16 wherein said first pair of guard plates are formed with cam slots, cam followers on each of said second guard plates engaged with said cam slots to rotate said second guards about said pivotal connection to said element to maintain said second guard plates in shielding relation with said multilink mechanism as it extends outwardly from between said first guard plates during movement of said door.

* * * * *

UNITED STATES PATENT AND TRADEMARK OFFICE

CERTIFICATE OF CORRECTION

PATENT NO. 5,239,776

DATED August 31, 1993

INVENTOR(S) Lhotak

It is certified that error appears in the above-indentified patent and that said Letters Patent is hereby corrected as shown below:

IN THE CLAIMS:

Column 14, line 17, change "pen" to --open--.

Signed and Sealed this

Fifth Day of July, 1994

Bruce Lehman

*Attest:*

BRUCE LEHMAN

*Attesting Officer*

*Commissioner of Patents and Trademarks*